United States Patent [19]

Capel

[11] 4,266,104

[45] May 5, 1981

[54] SWITCH MECHANISM WITH INDEPENDENT TOGGLE ACTUATORS

[75] Inventor: Denis Capel, Hardegarijp, Netherlands

[73] Assignee: Johnson Controls, Inc., Milwaukee, Wis.

[21] Appl. No.: 11,209

[22] Filed: Feb. 12, 1979

[51] Int. Cl.[3] ..... H01H 5/00

[52] U.S. Cl. ..... 200/18; 62/228; 200/67 D; 200/81.5; 340/626

[58] Field of Search ..... 200/18, 83 WM, 83 P, 200/83 S, 83 SA, 81 R, 82 H, 81.4, 81.5, 81.6, 81.8, 81.9 R, 81.9 M, 67 D, 61.69, 61.62, 1 R, 5 R; 62/228 R, 228 D; 340/611, 626

[56] References Cited

U.S. PATENT DOCUMENTS

| | | | |
|---|---|---|---|
| 3,435,628 | 4/1969 | Russell | 62/228 D |
| 4,128,747 | 12/1978 | Basse | 200/67 D |

*Primary Examiner*—J. V. Truhe
*Assistant Examiner*—Morris Ginsburg
*Attorney, Agent, or Firm*—Emrich, Root, Lee, Brown & Hill

[57] ABSTRACT

A switch mechanism includes a fixed contact bar on which two or more contacts may be mounted. A movable contact is associated with each of the fixed contacts. Two independent toggle mechanisms are provided, each responsive to a different pressure-responsive displacement actuator for selectively actuating one or more of the movable contacts. In one embodiment having two normally open and one normally closed set of contacts, one toggle mechanism is connected by a sliding yoke to the movable contacts of one normally open set and the normally closed set, and the other toggle mechanism is connected by a second, independent sliding yoke to the movable contacts of the other normally open set and the normally closed set. Hence the normally closed contacts (which may be used to de-energize a compressor motor) are opened if either pressure limit is exceeded, but only the normally open set is disclosed which is associated with the tripped toggle mechanism. This may be used to indicate an alarm. Each toggle mechanism may be automatically resetting or require manual reset.

10 Claims, 13 Drawing Figures

SWITCH MECHANISM WITH INDEPENDENT TOGGLE ACTUATORS

BACKGROUND AND SUMMARY

The present invention relates to a switch mechanism; and more particularly, it relates to a switch mechanism which is responsive to two or more displacement-type actuators. The term "displacement actuator" is intended to cover a broad class of mechanical actuators or transducers which sense pressure or force and convert it to mechanical movement or displacement such that the displacement is proportional to the parameter being sensed or monitored (pressure or force, for example). Mechanical linkage may be used to amplify the displacement which is then coupled to a toggle mechanism of a switch for tripping the switch if the displacement exceeds an amount which represents a predetermined threshold for the parameter being monitored.

Devices of this type find a wide range of application. For example, they are used in refrigeration or cooling systems in which one displacement actuator is responsive to the suction pressure of a compressor and a second displacement actuator is responsive to the output pressure of the compressor. It may be desired to shut the compressor off if the suction pressure falls below a predetermined low threshold (which may indicate loss of refrigerant or oil or a leak in the system), or if the outlet pressure exceeds a predetermined high threshold (which would present too great a load on the compressor motor). In this example, a switch would have a set of main contacts and one or more sets of auxiliary contacts. If either alarm condition sensed by the transducers occurred, it would be desired to open the main contacts and thereby de-energize the compressor motor, and to close the auxiliary contacts to indicate that an alarm condition exists.

A problem exists in conventional switch mechanisms of this type which contain two toggle mechanisms each responsive to a different displacement actuator and mechanically interconnected to open the main contacts when either sensing threshold or "set point" is exceeded in that each toggle mechanism itself typically includes a spring (for establishing bistable conditions in the switch mechanism) and some movement (which may be the output of the displacement actuator) is required to trip the toggle mechanism. If the toggle mechanisms are mechanically interconnected or connected in series, the outputs of each actuator has a tendency to interfere with and thereby change the threshold of the other toggle mechanism.

This is particularly true when the switches are used in refrigeration or cooling systems because the outputs of the displacement actuators change dynamically when the system is in operation. For example, once the compressor motor is energized, the output pressure increases while the suction pressure decreases simultaneously. Hence, if there is any mechanical interference or interrelation, the movement of one displacement actuator may vary the actual trip point of the toggle mechanism associated with the other displacement actuator, and this type of interference or interdependency has been found to exist in some present commercial structures.

Briefly, the present invention overcomes this problem by providing a switch which has two independent toggle mechanisms, each responsive to a different displacement actuator. In the illustrated embodiment, a set of main contacts are normally closed, and two sets of auxiliary contacts are normally open. One toggle mechanism is adapted by means of a first sliding yoke to actuate a movable contact of the main set and a movable contact of a first auxiliary set of contacts. The other toggle mechanism is similarly adapted by means of a second, independent sliding yoke to actuate the movable contact of the second auxiliary set and the movable contact of the main set. Each yoke has a shoulder which engages the movable main contact when the associated toggle mechanism is tripped, but the motion of the movable main contact is not reflected in the other toggle mechanism. Thus, the main contact can be moved without in any way interfering with or varying the spring forces in the other toggle mechanism.

With this structure, the normally closed contacts of the main set are opened if either pressure limit is exceeded, but the only auxiliary set that is closed is that which is associated with the tripped toggle mechanism. This auxiliary set of contacts may be used to indicate a specific alarm identifying which displacement actuator has exceeded its threshold. Either toggle mechanism, or both, may be set to trigger on a pressure rise (or increase above a set point) if a conventional reverse action linkage is used in connection with the associated displacement actuator.

The toggle mechanisms are independent in the sense that a varying pressure sensed by one of the displacement actuators does not change the spring forces of the other toggle mechanism.

Either toggle mechanism may have an automatic reset or it may have a manual reset independent of the other toggle mechanism. This is useful, for example, where it is desired to lock the system out if one threshold is exceeded (for example, the low suction pressure threshold), but simply to de-energize the compressor motor only for so long as the other sensed condition prevails (for example, only for so long as the high pressure threshold is exceeded).

Other features and advantages of the present invention will be apparent from the following detailed description of a preferred embodiment accompanied by the attached drawing wherein identical reference numerals will refer to like parts of the various views.

THE DRAWING

DETAILED DESCRIPTION

Figure 1:
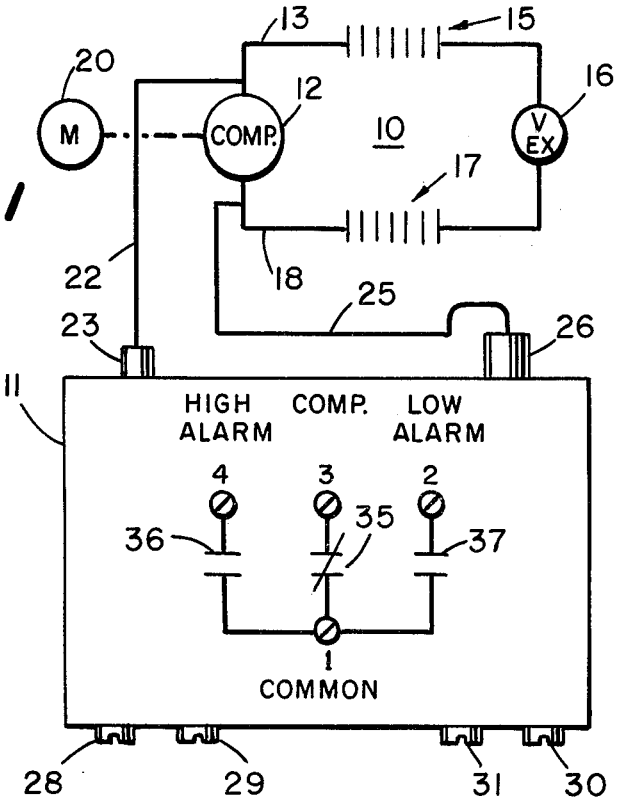
FIG. 1 is a function diagram of a refrigeration or cooling system employing a switch of the type with which the present invention is concerned.

Referring first to FIG. 1, there is shown in diagrammatic form a cooling or refrigeration system generally designated 10 which is used in combination with a switch mechanism enclosed in block 11, and being of the type with which the present invention is concerned. The refrigeration includes a compressor 12 feeding refrigerant under pressure to a condenser coil 15, which may be cooled by outside air by means of a fan (not shown). The refrigerant is then passed through an expansion valve 16 and into an evaporator coil generally designated 17, from which the refrigerant is returned through a line 18 to the suction side or input of the compressor 12. The compressor 12 is normally driven by an electrical motor 20.

Pressure at the output of the compressor 12 is sensed by means of a line or capillary 22 and coupled to a displacement actuator, diagrammatically illustrated at 23. Similarly, pressure at the suction end of the compressor 12 is communicated through a capillary 25 to the input of a low pressure displacement actuator 26. Each of the actuators 23, 26 may be of the type sold under the designation P78 by the Penn Controls Division of Johnson Controls, Inc., Oak Brook, Ill. Other types of displacement actuators may equally well be used with a switch mechanism of the present invention. Typically, such displacement actuators employ a movable element which may be connected to the end of a capillary by means of a bellows or other expansion seal for being displaced as a function of pressure in the capillary. The displacement may be used to directly actuate a switch or, through a conventional inverting lever mechanism, the motion of the displacement member may be "inverted"—that is, the actuating displacement increases as the pressure decreases. The high pressure displacement actuator 23 has associated with it a screw 28 for adjusting range, and a screw 29 for adjusting the differential. Similarly, the low pressure actuator 26 has range and differential adjusting screws 30, 31, respectively.

The switch 11 includes a set of normally closed contacts 35 connected between a common terminal designated 1 and a secondary terminal 3. The contacts 35 are sometimes referred to as the main contacts. The switch also includes first and second sets of normally open auxiliary contacts 36, 37 connected respectively between the common terminal 1 and a high alarm terminal 4 and a low alarm terminal 2. The terminal 3 may be connected to the compressor motor.

Figure 2:
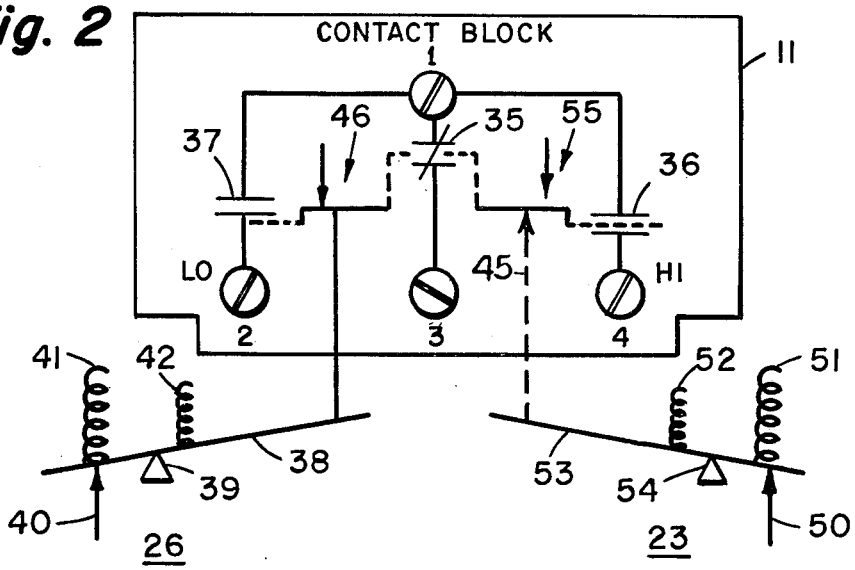
FIG. 2 is a schematic diagram of a switch constructed according to the present invention and two displacement actuators, also in diagrammatic form.

Turning now to FIG. 2, the overall operation of the switch 11 is illustrated diagrammatically. The low pressure displacement actuator 26 includes a main operating lever 38 which is in contact with a fulcrum 39. The movable portion of the displacement actuator exerts a force diagrammatically illustrated by the arrow 40 which is opposed by a first spring 41 and assisted by a second spring 42. The lever 38 directly operates a toggle mechanism generally designated 46 which opens the main contacts 35 to shut off the compressor, and closes contacts 37 to indicate an alarm. When the pressure again comes within design range, the spring 41 causes the lever 38 to move and this motion is used to actuate the toggle mechanism 46.

The high pressure transducer 23 is shown in similar schematic form, including a force 50, first and second springs 51, 52, a main operating lever 53, and a fulcrum 54. In this case, the reverse motion of the lever 53 is coupled through a reverse action linkage, diagrammatically illustrated by the dashed line 45, to actuate the toggle mechanism 55 which opens the main contacts 35 and closes the alarm or auxiliary contacts 36 indicating a high pressure alarm.

In summary, when the low pressure displacement actuator 26 senses an alarm condition, the auxiliary contacts 37 are actuated, but the contacts 36 are not. Conversely, when the high pressure transducer senses an alarm condition, the contacts 36 are actuated, but the contacts 37 are not. The main contacts 35 are actuated in either case.

Figure 3:
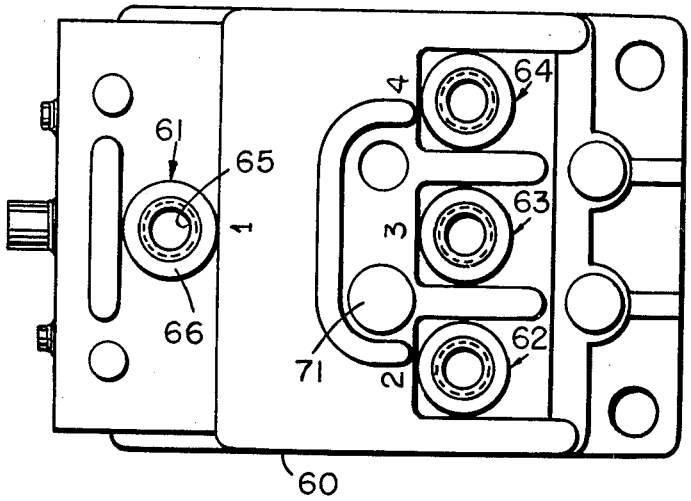
FIG. 3 is a plan view of a contact block incorporating the switch structure of the present invention.

Referring now to FIG. 3, a contact block or base is generally designated 60. The illustrated block 60 is designed to be mounted on a displacement actuator of the type identified above. The previously-identified terminals 1–4 are indicated on the block 60, and each is provided with a terminal stud designated respectively 61, 62, 63 and 64. Each of the terminal studs is similar in structure, including an internally threaded bore (such as that designated 65 for the stud 61) and a shoulder 66 for receiving a wire. A screw (see 67 in FIG. 11) is received in the threaded bore 65 for securing the wire to the terminal stud.

Figure 4:
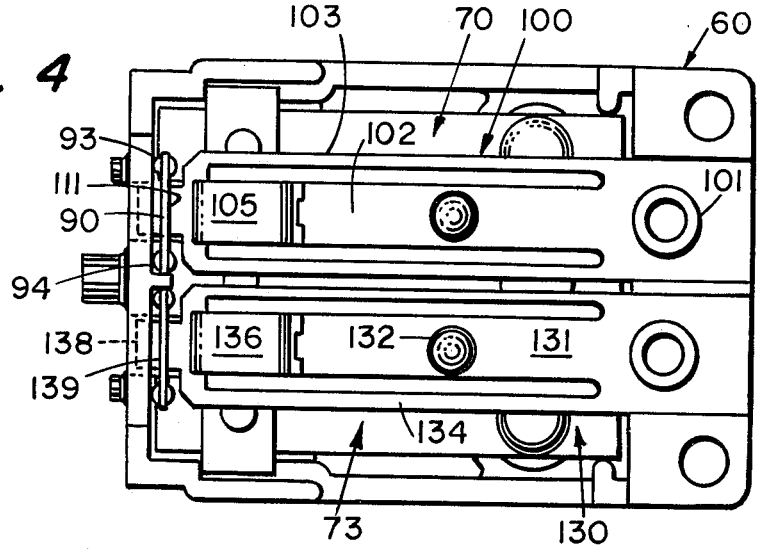
FIG. 4 is a bottom view of the contact block of FIG. 3.
Figure 5:
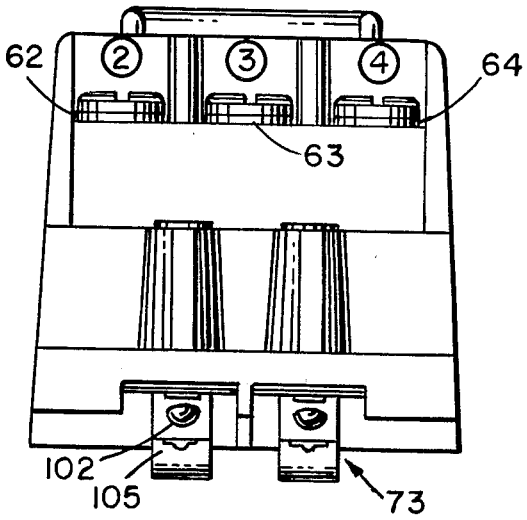
FIG. 5 is a right side view of the contact block of FIG. 3.
Figure 11:
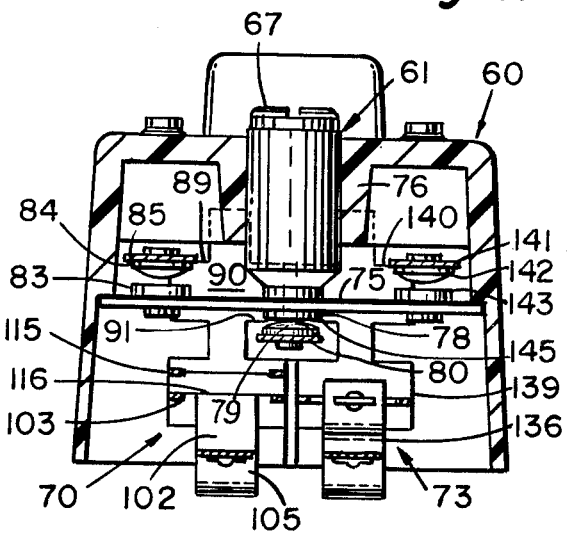
FIG. 11 is a transverse vertical cross sectional view taken through the sight line 11—11 of FIG. 6 showing a manually resettable toggle mechanism on the left and an automatically resetting toggle mechanism on the right, both in their untripped states.

In the illustrated embodiment, two toggle mechanisms are shown. Referring more generally to FIGS. 4, 5 and 11, one of the toggle mechanisms is adapted for manual reset, and it is generally designated by reference numeral 70. The manually reset toggle mechanism is located in the upper half of the base 60 as seen in FIG. 4, and it includes a reset pin 71 which extends above the top of the base 60.

A second toggle mechanism generally designated 73 is adapted for automatic reset (that is, it resets when the sensed pressure returns to design range); and it is located in the lower half of the base 60 as viewed in FIG. 4. The base 60 acts as a housing for the toggle mechanisms. In a typical application, it may be desirable to require manual reset on a suction pressure alarm (because a leak might be indicated), whereas the high pressure alarm may be automatically reset, indicating that the outlet pressure has returned to a normal operating range so that the compressor may be restarted.

MANUAL RESET TOGGLE MECHANISM

Referring now particularly to FIG. 11, a contact bar 75 is secured to the bottom of the terminal stud 61 which is supported by a collar 76 formed in the base 60. A fixed contact 78 is staked to the weld stud 61 beneath the fixed contact bar 75. A first movable contact 79 is mounted to the distal end of a leaf contact spring 80, the other end of which is riveted to the bottom of the weld stud 63. The contact spring 80 exerts force on the movable contact 79 such that the contacts 78 and 79 (interposed between terminals 1 and 3) are normally closed.

These contacts thus correspond to the normally closed contacts 35 of FIGS. 1 and 2.

Figure 6:
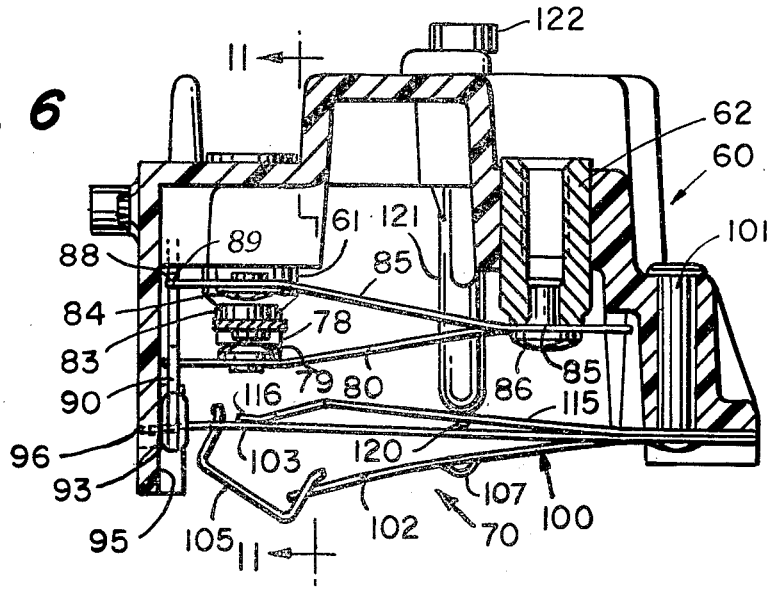
FIG. 6 is a vertical cross sectional view through the contact block of FIG. 3 showing a manually resettable toggle mechanism in its normal or untripped state.

Referring now to FIG. 11, the left side of the contact bar 75 is provided with a second fixed contact 83 which is located on the upper side of the bar. Above the fixed contact 83 is a movable contact 84 which is mounted to the distal end of a contact leaf spring 85, the other end of which is fixed by means of a rivet 86 to the bottom of the terminal stud 62, as best seen in FIG. 6. The leaf spring 85 is shaped so as to exert a force on the contact 84 causing it to engage the contact 83. However, the distal end of the leaf spring 85, designated 88 in FIG. 6 rests on a shoulder 89 of a yoke 90.

The yoke 90 is made of non-conducting material, and it is provided with stand-off portions 93, 94 (see FIG. 4) which act as bearing or sliding surfaces permitting the yoke to slide along an inner surface 95 of a wall 96 of the casing 60. The upper portion of the yoke may be provided with similar stand-off ribs.

Figure 12:
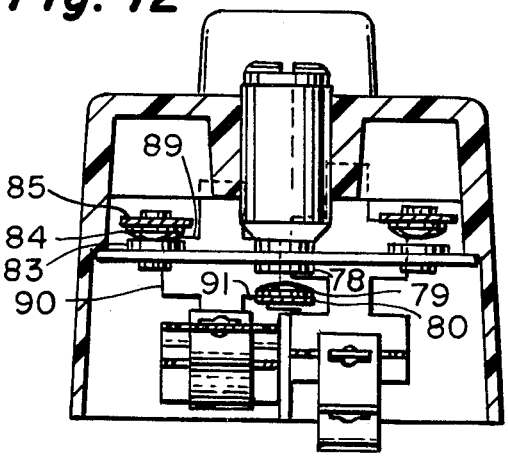
FIG. 12 is a view similar to FIG. 11 showing the manually resettable toggle mechanism tripped.

As seen in FIG. 11, the yoke 90 is in its raised position and it is adapted to slide between that position and a lowered position seen in FIG. 12. Briefly, when the yoke 90 is moved to the position of FIG. 12, the shoulder 89 disengages the leaf spring 85 permitting auxiliary contacts 83, 84 to close; and at the same time, the shoulder 91 engages the distal end of the spring 80, to open the main contacts 78, 79.

Referring now to FIGS. 4 and 6, it is the manually resettable toggle mechanism 70 which normally biasses the sliding yoke 90 to the raised position but which, in response to the movement of a displacement actuator (to be described) becomes tripped and drives the yoke 90 to the lowered or second stable position. The toggle mechanism 70 is sometimes referred to as being bistable in that it has two stable states, shown respectively in FIGS. 6 and 7, and to be described presently.

Still referring to FIGS. 4 and 6, the manually resettable toggle mechanism 70 includes an actuator spring generally designated 100 which is secured at one end to the base 60 by means of a rivet 101.

The actuator spring is formed to provide a first movable portion 102 in the form of a tongue, and a second movable portion 103 which surrounds the tongue. The adjacent far ends of the movable portions 102, 103 define tabs extending toward one another which are received in corresponding apertures of a C-shaped spring 105. It is the C-shaped spring 105 which maintains the movable portions 102, 103 of the actuator spring 100 in one of its bistable states, shown respectively in FIGS. 6 and 7.

Figure 7:
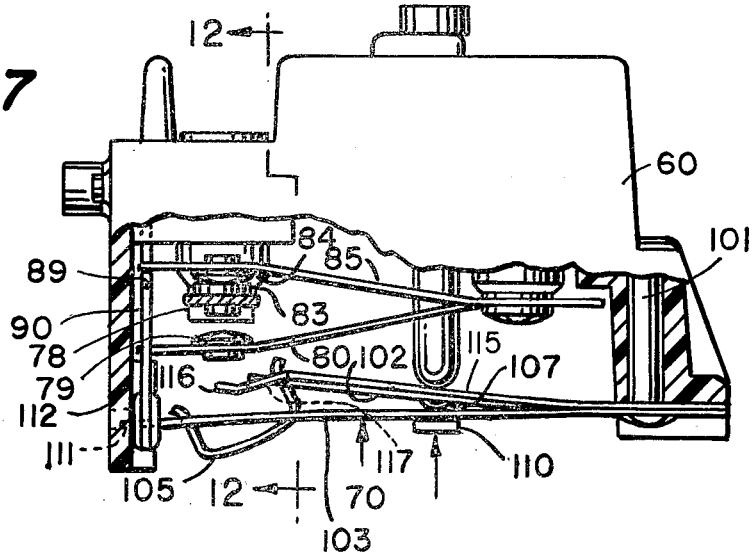
FIG. 7 is a partially sectioned view similar to FIG. 6 showing the toggle mechanism after it is tripped.

A detent 107 is formed in the central area of the movable portion 102 of the actuator spring, and it is this detent which is engaged by a displacement actuator, diagrammatically illustrated at 110 in FIG. 7.

The distal end of the movable portion 103 of the actuator spring defines a tab 111 which is received in an aperture in the base of the yoke 90 and extends into an aperture 112 in the wall 96 of the base 60. It is the aperture 112 which limits the movement of the second movable portion 103 of the actuator spring 100 in the two stable positions. The snap action between the stable positions is enhanced because the ends of the C-shaped spring 105 are compressed together and thereby exert increased force as the first movable portion 102 of the actuator spring passes over center through the second movable portion 103. It will be observed from a comparison of FIGS. 6 and 7 that when the first movable portion 102 is lower than the second movable portion 103, the C-shaped spring exerts an upward force on the movable portion 103 to raise the yoke 90; whereas in the second stable state, the C-shaped spring 105 exerts a downward force on the movable portion 103 of the actuator spring to lower the slide 90 to the position of FIG. 7.

A reset spring 115 is located above the actuator spring 100, and it is also secured to the base of the contact block by means of the rivet 101. The reset spring 115 is a leaf spring having its distal end formed into a transverse edge 116 or rib which is located beyond the distal end of the first movable portion or tongue 102 of the actuator spring. Further, the central portion of the reset spring 115 is stamped out to define an aperture designated 117 to permit the distal end of the tongue 102 as well as the C-shaped spring 105 to pass through it when the mechanism is tripped (see FIG. 7).

Figure 8:
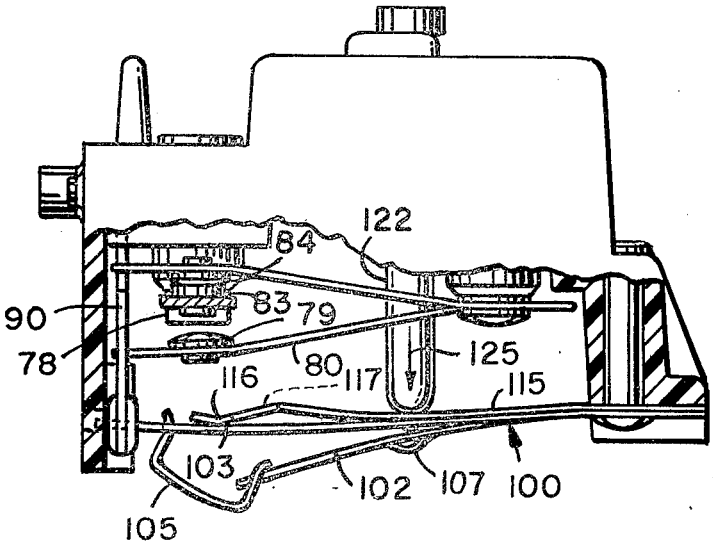
FIG. 8 is a view similar to FIG. 7 showing the toggle mechanism being manually reset.

Referring to FIG. 6, the reset spring 115 is also apertured to receive a tip 120 of a reset pin 121 which is slidably received in the top of the base 60 and extends above the base where it defines a head 122 which, when pushed, depresses the pin 121 in the direction of the arrow 125 of FIG. 8 to reset the tongue 102 of the actuator spring from the tripped position of FIG. 7 to the reset position of FIG. 8.

OPERATION OF MANUALLY RESETTABLE TOGGLE MECHANISM

The normal or untripped position of the manually resettable toggle mechanism is shown in FIGS. 6 and 11. In this state, the movable tongue 102 of the actuator spring 100 is beneath the movable portion 103; and the C-shaped spring 105 urges the movable portion 103 upwardly. This, in turn, causes the sliding yoke 90 to be moved to its upper position. When the yoke 90 is raised (as best seen in FIG. 11), the shoulder 91 is displaced above the leaf spring 80 for the normally-closed or main contacts 78, 79 which are then closed, and the shoulder 89 lifts the spring 85 of the first set of auxiliary contacts 83,84 which are then opened, the movable contact 84 being raised against the bias of movable contact spring 85. The movable main contact 79 is closed under the normal bias of contact spring 80.

Referring now to FIG. 7, when the actuator 110 displaces the detent 107 such that the connection between the tongue 102 and the C-shaped spring 105 moves over center relative to the connection between the C-shaped spring 105 and the second movable portion 103 of the actuator spring, the tongue 102 snaps to the position of FIG. 7 where it is limited by the reset spring 115; and the movable portion 103 of the actuator spring is lowered until the tab 111 bottoms in the aperture 112. This slides the yoke 90 downwardly, so that the shoulder 89 disengages the upper contact spring 85, thereby closing the auxiliary contacts 83, 84, and at the same time, causing the shoulder 91 (FIG. 11) to engage the top of the contact spring 80 and open the contacts 78, 79. The toggle mechanism remains in the second stable state until the reset pin 122 is depressed in the direction of the arrow 125 of FIG. 8, thereby moving the tongue 102 downwardly until the C-shaped spring 105 causes it to snap back to the original position. During this action, it will be observed that the reset pin 122 deforms the reset spring 115. This prevents re-closing of contacts 78, 79 and re-opening of contacts 83, 84 until pin 122 is released providing "trip free" operation. When the reset pin is released, the C-shaped spring 105 causes the movable portion 103 of the actuator spring to lift the yoke 90 to the raised position, thereby closing contacts 78, 79 and opening contacts 83, 84. Thus, the contacts return to their normal positions under force.

AUTOMATIC RESET TOGGLE MECHANISM

Turning now to the automatic reset toggle mechanism 73 it includes some parts which may be identical to those used in the manually resettable toggle mechanism described above. Hence, these elements need not be disclosed in great detail. Such elements include an actuator spring generally designated 130 in FIG. 4 having a central tongue 131 in which a detent 132 is formed, and a second movable portion 134. The movable portions 131, 134 are connected by a C-shaped spring 136. The distal end of the movable portion 134 includes a tab 138 which is received in a vertically slidable yoke 139 similar to the previously described yoke 90. As best seen in FIG. 11, the yoke 139 includes a shoulder 140 which engages and lifts a contact spring 141 when the yoke is raised. A contact 142 is mounted to the spring 141 in alignment with a fixed contact 143 staked to the contact bar 75.

The yoke 139 also includes a shoulder 145 which is laterally aligned with the shoulder 91 of the adjacent yoke 90, and is adapted to engage the contact spring 80 on which the movable main contact 79 is mounted. Thus, when the yoke 139 is displaced to its lowered position, the normally open auxiliary contacts 142, 143 close, and the normally closed main contacts 78, 79 are open. It will be observed that each of the yokes (which may broadly be thought of as connecting members between the respective toggle mechanisms and the movable main contact) are cut away beneath the shoulders 91, 145 so that the contact spring 80 may freely move away from either shoulder. It is considered an important advantage of the present invention that if either of the toggle mechanisms is tripped, the main contacts are actuated independent of the other toggle mechanism, without cross-coupling or interference. The structure just described permits this advantageous operation.

Figure 9:
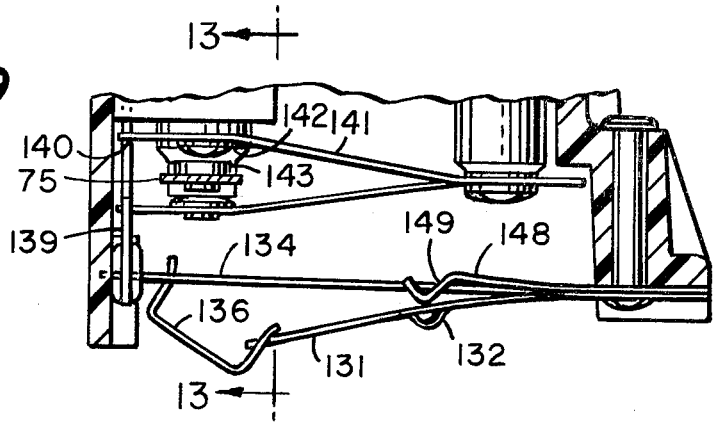
FIG. 9 is a close up fragmentary vertical cross sectional view of the automatically resetting toggle mechanism for the structure of FIG. 3 shown in its untripped or normal state.
Figure 10:
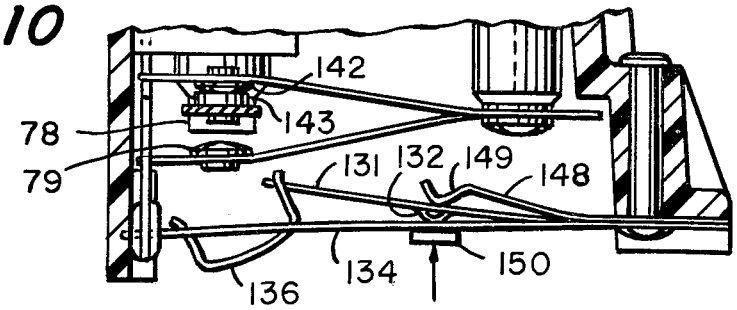
FIG. 10 is a view similar to FIG. 9 showing the toggle mechanism tripped.

The principal difference between the automatically resetting toggle mechanism and the manually resettable toggle mechanism, as best seen in FIGS. 9 and 10 is that a reset spring 148 is bent to form a rib 149 at a location adjacent the detent 132. The force exerted by the reset spring 148 is such that the toggle mechanism will be tripped only for so long as the displacement actuator (diagrammatically illustrated at 150) is in the extended position. When the actuator returns, the rib of reset spring 148 will force the tongue 131 back to is original position.

OPERATION OF AUTOMATICALLY RESETTING TOGGLE MECHANISM

The normal or untripped state of the automatically resetting toggle mechanism is shown in FIG. 9, and on the right side of FIGS. 11 and 12. In this state, the tongue 131 is beneath the second movable portion 134 of the actuator spring; and the C-shaped spring 136 exerts an upward force on the second movable portion 134 of the actuator spring 130 which, in turn, moves the yoke 139 upwardly. The shoulder 140 of the yoke 139 raises the contact spring 141 (which normally biases the contact 142 downwardly) to open the auxiliary contacts 142, 143; and the main contacts 78, 79 are also closed (provided the other toggle mechanism is not tripped) under the bias of contact spring 80.

When the actuator 150 engages the detent 132 (FIG. 10) and urges it upwardly so that the connection between the C-shaped spring 136 and the tongue 131 moves over center relative to the connection between the C-shaped spring 136 and the movable portion 134 of the actuator spring, the actuator spring will snap to its second stable position (as seen in FIG. 10) provided the actuator 150 continues to hold the tongue 131 in the raised position.

Figure 13:
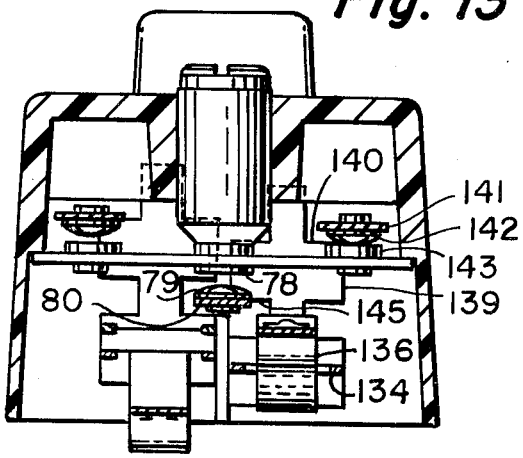
FIG. 13 is a view similar to FIG. 11 showing the automatically resetting toggle mechanism tripped.

In the position of FIG. 10, the C-shaped spring 136 urges the slide 139 to the lowered position as seen in FIG. 13. In this position, the contact spring 141 urges auxiliary contacts 142, 143 closed; and the shoulder 145 of the yoke 139 moves the contact spring 80 downwardly to open the main contacts 78, 79.

When the actuator 150 retracts to a position below the threshold that trips the toggle mechanism, the reset spring 148 forces the tongue 131 downwardly; and the actuator spring returns to the position of FIG. 9.

It will thus be appreciated that the present invention permits either one of the toggle mechanisms to actuate the main contacts when the toggle mechanism is tripped, while actuating only the auxiliary contacts associated with the tripped toggle mechanism. That is to say, either toggle mechanism may actuate the main contacts and its associated auxiliary contacts while leaving the other auxiliary contacts undisturbed. These functions are accomplished in a structure in which there is no mechanical interference between one toggle mechanism and the other. That is, either displacement actuator may move its associated actuator spring a limited amount, but unless the actuator spring is tripped, the movement of the displacement actuator is not reflected in any manner in the other toggle mechanism. This is in contradistinction to prior art structures in which spring tension on one trip mechanism affected the threshold setting of the other trip mechanism.

Another feature of the invention is that either trip mechanism may be manually resettable or automatically resetting without regard to the other.

Still another advantage of the present invention is that it lends itself to a wide range of application. Although in the illustrated embodiment the trip mechanisms were associated with alarm points, the structure could easily be modified so that one or both of the toggle mechanisms reflected a set point, as distinguished from an alarm point. For example, both trip mechanisms could be associated with suction pressure having different actuating pressures. A first suction pressure could be used to actuate associated auxiliary contacts, so as to indicate to the operator that surveillance may be required, but which would not actuate the main contacts that turn off the compressor. If the suction pressure increased still further, the other toggle mechanism could then be used to actuate the main contacts and its associated auxiliary contacts which could then be used to sound an alarm condition. In this application, the first toggle mechanism might be automatically resetting and the second toggle mechanism might require manual reset. Persons skilled in the art will readily conceive of other useful applications due to the flexibility of the structure.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. A switch responsive to at least first and second displacement actuators comprising a non-conductive base; first, second and third pairs of contacts, each pair of contacts having a normal state and an actuated state; means for fixedly mounting one contact of each of said pairs to said base; means for mounting the other contact of each of said pairs for independent movement relative to their associated fixed contacts; first and second toggle mechanisms independently responsive to said first and second displacement actuators, each toggle mechanism including a movable member movable from a first position to a second position when said toggle mechanism is actuated by its associated displacement actuator; first and second link means connected respectively to said first and second movable members of said toggle mechanisms for independent movement between first and second positions, each link means being operative to move the movable contact of said second pair of contacts to its actuated state when said link means is moved to its second position, while permitting said movable contact of said second pair of contacts to be independently actuated by the other link means, said first and second link means further being operative respectively to actuate the movable contacts of said second and third pairs of contacts when the associated link means is moved to its second position, whereby said toggle mechanisms are actuated independent of each other and without interference caused by the displacement actuator's effect on the other toggle mechanism.

2. The apparatus of claim 1 further comprising a leaf contact spring, said movable contact of said second pair of contacts being mounted on said contact spring, and wherein each of said link means comprises a yoke slidably disposed in said base for parallel movement relative to each other, each yoke including a shoulder for engaging said contact spring when the associated movable member moves from said first position to said second position to thereby actuate said second pair of contacts.

3. The apparatus of claim 2 wherein said shoulders of the first and second yokes are laterally spaced and aligned with each other to one side of said contact spring when said toggle mechanisms are in corresponding states.

4. The apparatus of claim 3 further comprising second and third leaf contact springs for mounting respectively the movable contacts of said first and third pairs of contacts, shoulders of said yokes engaging said second and third contact springs respectively for actuating the movable contacts of said first and third pairs of contacts respectively when said first and second toggle mechanisms are actuated.

5. The apparatus of claim 1 wherein each toggle mechanism includes a leaf actuator spring mounted to said base and having first and second movable portions, one of said movable portions of each toggle mechanism adapted to be engaged respectively by an associated displacement actuator; and first and second bendable springs interconnecting said first and second movable portions of said leaf springs respectively for permitting said portions interconnected thereby to independently assume one of two stable states, one of said movable portions providing said movable member connected to its associated link means.

6. The apparatus of claim 5 wherein at least one of said toggle mechanisms is manually resettable and includes a reset spring engageable by the first movable portion of said actuator spring when said actuator spring is actuated by its associated displacement actuator; and a reset actuator pin slidably mounted in said base and urged to a first position by said reset spring, said actuator pin when depressed urging said reset spring against said first movable portion of said actuator spring for returning said toggle mechanism to its original position.

7. The apparatus of claim 5 wherein at least one of said toggle mechanisms is automatically resettable when its associated displacement actuator returns to its normal position, sad toggle mechanism including a reset spring adapted to engage said first movable portion of said actuator spring when said first movable portion is actuated by its associated displacement actuator for returning said first movable portion to its original position when its associated displacement actuator returns to its original state.

8. A switch responsive to at least first and second displacement actuators comprising a non-conductive base; a contact bar assembly mounted to said base and including at least first, second and third fixed contacts; first, second and third movable contact means associated respectively with said first, second and third fixed contacts; each of said movable contact means being movable between a normal position and an actuated position; first and second toggle means each having first and second stable states responsive to said first and second displacement actuators respectively for independently moving from said first state to said second state; first link means responsive to said first toggle means for actuating said first and second movable contact means when said first toggle means is actuated to said second state; and second link means independently movable relative to said first link means responsive to said second toggle means for actuating said second and third movable contact means to their respective actuated positions when said second toggle means is actuated to said second state; whereby said second movable contact means is responsive to the actuation of either of said toggle means, and said first and third contact means are independently responsive to the actuation of said first and second toggle means respectively.

9. A switch responsive to at least first and second displacement actuators comprising a non-conductive base; first, second and third pairs of contacts, each pair of contacts having a normal state and an actuated state; means for fixedly mounting one contact of each of said pairs to said base; means for mounting the other contact of each of said pairs for independent movement relative to its associated fixed contact; a first toggle mechanism responsive to said first displacement actuator for operating said first and second pairs of contacts; a second toggle mechanism responsive to said second displacement actuator for operating said second and third pairs of contacts independent of said first toggle mechanism, at least one of said toggle mechanisms being manually resettable and comprising a first leaf spring mounted at one end to said base and including first and second movable portions; a second spring connected between said movable portions of said first leaf spring to hold said movable portions in one of two stable states, said first movable portion being engaged by one of said displacement actuators; a yoke slidably disposed in said base and connected to said second movable portion of said first leaf spring to move therewith between first and second stable positions, said yoke engaging one of said movable contacts when said yoke is displaced from said first to said second position to actuate the same when said first movable portion of said leaf spring is actuated by said displacement actuator to its second stable state, thereby to actuate said first set of contacts; and a pin slidably received in said base and adapted to move said first spring to the first stable state and thereby displace said yoke to its original position.

10. A switch responsive to at least first and second displacement actuators comprising a non-conductive base; first, second and third pairs of contacts, each pair of contacts having a normal state and an actuated state; means for fixedly mounting one contact of each of said pairs to said base; means for mounting the other contact of each of said pairs for independent movement relative to its associated fixed contact; a first toggle mechanism responsive to said first displacement actuator for operating said first and second pairs of contacts; a second toggle mechanism responsive to said second displacement actuator for operating said second and third pairs of contacts independent of said first toggle mechanism, at least one of said toggle mechanisms being automatically resetting and comprising a leaf actuator spring mounted at one end to said base and including first and second movable portions; a spring connected between said movable portions of said actuator spring to hold said movable portions in one of two stable states, said first movable portion being engaged by an associated displacement actuator; a yoke slidably disposed in said base and connected to the movable portion of an associated actuator spring for movement therewith between first and second stable positions, said yoke being operative to actuate the movable contacts of said first and second pairs of contacts when said yoke is disposed from said first to said second position; and a reset spring for engaging one of the movable portions of said actuator spring when said actuator spring is tripped by said displacement actuator for biassing said actuator spring to its original position and returning said actuator spring to its original position when said displacement actuator assumes its normal position.

* * * * *